US007044223B2

(12) United States Patent
Dalrymple et al.

(10) Patent No.: US 7,044,223 B2
(45) Date of Patent: May 16, 2006

(54) HEATER CABLE AND METHOD FOR MANUFACTURING

(75) Inventors: Larry V. Dalrymple, Claremore, OK (US); David H. Neuroth, Claremore, OK (US); Phillip R. Wilbourn, Claremore, OK (US); Don C. Cox, Roanoke, TX (US); Thomson H. Wallace, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 91 days.

(21) Appl. No.: 10/781,365

(22) Filed: Feb. 18, 2004

(65) Prior Publication Data

US 2004/0163801 A1 Aug. 26, 2004

Related U.S. Application Data

(60) Division of application No. 10/047,294, filed on Jan. 14, 2002, now Pat. No. 6,695,062, which is a continuation-in-part of application No. 09/939,902, filed on Aug. 27, 2001, now Pat. No. 6,585,046.

(51) Int. Cl.
*E21B 36/04* (2006.01)

(52) U.S. Cl. ..... 166/302; 166/57; 174/DIG. 33

(58) Field of Classification Search ..... 166/65.1, 166/302, 57, 62; 174/DIG. 33
See application file for complete search history.

(56) References Cited

U.S. PATENT DOCUMENTS

| | | | | | |
|---|---|---|---|---|---|
| 2,799,608 | A | * | 7/1957 | Scott | 156/52 |
| 3,023,300 | A | * | 2/1962 | Lehnert | 219/60 R |
| 3,103,453 | A | * | 9/1963 | Jones | 148/519 |
| RE28,961 | E | * | 9/1976 | Tsukamoto et al. | 29/624 |
| 4,104,481 | A | * | 8/1978 | Wilkenloh et al. | 174/28 |
| 4,346,256 | A | | 8/1982 | Hubbard et al. | 174/47 |
| 4,484,023 | A | * | 11/1984 | Gindrup | 174/102 R |
| 4,681,169 | A | | 7/1987 | Brookbank, III | 166/385 |
| 4,780,574 | A | * | 10/1988 | Neuroth | 174/102 D |
| 5,145,007 | A | | 9/1992 | Dinkins | 166/386 |
| 5,146,982 | A | | 9/1992 | Dinkins | 166/65.1 |
| 5,191,173 | A | * | 3/1993 | Sizer et al. | 174/105 R |
| 5,269,377 | A | | 12/1993 | Martin | 166/385 |
| 5,782,301 | A | | 7/1998 | Neuroth et al. | 166/302 |
| 5,821,452 | A | | 10/1998 | Neuroth et al. | 174/28 |
| 6,103,031 | A | | 8/2000 | Aeschbacher et al. | 156/54 |
| 6,143,988 | A | | 11/2000 | Neuroth et al. | 174/105 R |
| 6,167,915 | B1 | | 1/2001 | Collie et al. | 138/114 |
| 6,260,615 | B1 | | 7/2001 | Dalrymple et al. | 166/60 |
| 6,585,046 | B1 | * | 7/2003 | Neuroth et al. | 166/302 |
| 6,596,393 | B1 | * | 7/2003 | Houston et al. | 428/389 |

* cited by examiner

*Primary Examiner*—William P. Neuder
(74) *Attorney, Agent, or Firm*—Bracewell & Giuliani LLP

(57) ABSTRACT

A method for manufacturing an electrical cable provides an electrical cable suitable for use in heating wells. An elastomeric jacket is extruded over insulated conductors. A stainless steel plate is rolled around the jacket to form a cylindrical coiled tubing having a seam. The seam is welded, then the tubing is swaged down to a lesser diameter to cause the tubing to frictionally grip the jacket. A recess maybe formed in the jacket adjacent the seam to avoid heat damage from the welding process.

19 Claims, 2 Drawing Sheets

11
13
15
17
19
21
23
25
25a
25b
25c
27
29
31
33
35
55
a
b

HEATER CABLE AND METHOD FOR MANUFACTURING

CROSS REFERENCE TO RELATED APPLICATION

This application is a divisional of application Ser. No. 10/047,294, filed Jan. 14, 2002, now U.S. Pat. No. 6,695,062, which was a continuation-in-part of Ser. No. 09/939,902, filed Aug. 27, 2001, now U.S. Pat. No. 6,585,046.

FIELD OF THE INVENTION

This invention relates in general to applying heat to wells and in particular to a heater cable that is deployable while the well is live.

BACKGROUND OF THE INVENTION

Occasions arise wherein it is desirable to add heat to a hydrocarbon producing well. For example, U.S. Pat. No. 5,782,301 discloses a heater cable particularly for use in permafrost regions. The heater cable in that instance is used to retard the cooling of the hydrocarbon production fluid as it moves up the production tubing, which otherwise might cause hydrates to crystalize out of solution and attach themselves to the inside of the tubing. Also, if water is present in the production stream and production is stopped for any reason, such as a power failure, it can freeze in place and block off the production tubing.

Another application involves gas wells, which often produce liquids along with the gas. The liquid may be a hydrocarbon or water that condenses as the gas flows up the well. The liquid may be in the form of a vapor in the earth formation and in lower portions of the well due to sufficiently high pressure and temperature. The pressure and the temperature normally drop as the gas flows up the well. When the vapor reaches its dew point, condensation occurs, resulting in liquid droplets. Liquid droplets in the gas stream cause a pressure drop due to frictional effects. The pressure drop results in a lower flow rate at the wellhead. The decrease in flow rate due to the condensation can cause a significant drop in production if the quantity and size of the droplets are large enough. A lower production rate causes a decrease in income from the well. In severe cases, a low production rate may cause the operator to abandon the well.

Applying heater cable to a well in the prior art requires pulling the production tubing out of the well, strapping a heater cable to the tubing and lowering the tubing back into the well. One difficulty with this technique in a gas well is that the well would have to be killed in order to pull the tubing. This is performed by circulating a liquid through the tubing and tubing annulus that has a weight sufficient to create a hydrostatic pressure greater than the formation pressure. However, in low pressure gas wells, killing the well is risky in that the well may not readily start producing after the killing liquid is removed. The killing liquid may flow in the formation, blocking return of gas flow.

The heater cable of the type in U.S. Pat. No. 5,782,301 does not have the ability to support its own weight. It must be supported by another structure, such as the production tubing. Proposals have been made for installing a coiled tubing with a heater cable located therein. Coiled tubing is a metal continuous tubing that is deployed from a reel to the well. The diameter is typically from about 2 to 2⅞ inch. Coiled tubing is normally made of a mild steel in a seam welding process. After welding, it is annealed to provide resistance to cracking as it is wound on and off a reel, produced by rolling a flat plate. If heater cable is to be located within a string of coiled-tubing, it will be pulled through the cable after the annealing process because the temperatures employed during annealing would damage the insulation of the heater cable. A variety of techniques, including standoffs, dimples and the like have been proposed to cause the power cable to grip the coiled tubing to transfer its weight to the coiled tubing. Because of the standoffs, the outer diameter of the coiled tubing is larger than desirable. When deployed within production tubing, coiled tubing reduces the flow area of the production tubing, increasing pressure drop and frictional losses.

SUMMARY OF TEE INVENTION

The heater cable for this invention has at least one insulated conductor. An elastomeric jacket is extruded over the insulated conductor, the jacket having a cylindrical exterior that has a longitudinally extending recess formed thereon. A metal tubing having a cylindrical inner wall and a longitudinally extending weld seam is formed around the jacket. The seam of the metal tubing is welded in a continuous process and is located adjacent the recess so as to avoid excessive heat to the jacket while the seam is being welded. The coiled tubing initially has a greater inner diameter than the outer diameter of the jacket. After welding the seam, the coiled tubing is swaged to a lesser diameter, causing its inner wall to frictionally grip the jacket.

The coiled tubing is preferably formed of a stainless steel that provides sufficient strength and toughness to be used as coiled tubing without an annealing process. Preferably, the outer diameter of the coiled tubing after swaging is no greater than one inch.

DESCRIPTION OF THE PREFERRED EMBODIMENT

Figures 1, 2, 3, 5:
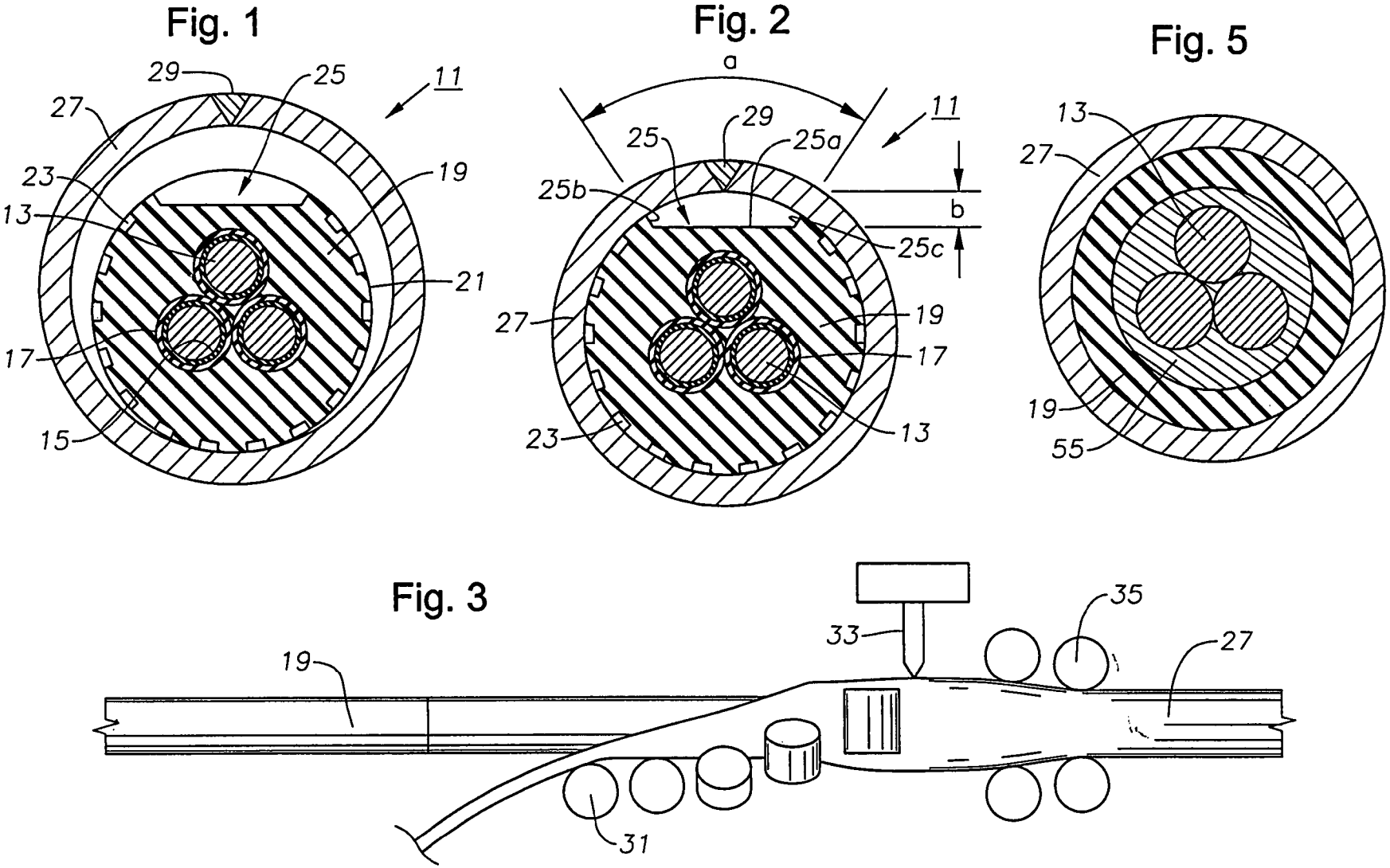
FIG. 1 is a sectional view of an electrical cable installed within a coiled tubing, shown during a manufacturing process in accordance with this invention.
FIG. 2 is a sectional view of the cable of FIG. 1 after the coiled tubing has been swaged.
FIG. 3 is a schematic view of the manufacturing process for the electrical cable of FIGS. 1 and 2.
FIG. 5 is a sectional view of the lower end of the cable of FIGS. 1 and 2.

Referring to FIG. 1, heater cable 11 has a plurality of conductors 13. Conductors 13 are preferably fairly large copper wires, such as 6AWG. Each conductor 13 has at least one layer of high temperature electrical insulation and in the preferred embodiment, two layers 15, 17. Insulation layers 15, 17 maybe of a variety of materials, but must be capable of providing electrical insulation at temperatures of about 60 to 150 degrees F. above the bottom hole temperature of the well. In one embodiment, inner layer 15 is formed from a polyimide such as Kapton, marketed by DuPont. Outer layer 17 protects inner layer 15 and is formed of a fluoropolymer, preferably MFA, which is a co-polymer of tetrafluoroethylene and perfluoromethylvinylether. Layers 15 and 17 are formed on conductors 13 by extrusion.

The three insulator conductors 13 are twisted together and an elastomeric jacket 19 is extruded over them. Jacket 19 provides structural protection and also is an electrical insulator. Jacket 19 also must be able to withstand temperatures of about 60 to 150 degrees F. above the bottom hole temperature of the well and can be of a variety of materials, the preferred being an EPDM (ethylenepropylenediene monomer) material. Generally, bottom hole temperatures in wells in which heater cable 11 would be deployed would not exceed about 250° F.

Jacket 19 has a cylindrical exterior 21 that has a plurality of grooves 23 thereon. Grooves 23 extend longitudinally along the axis of jacket 19 and in this embodiment are rectangular in cross-section. Grooves 23 are separated from each other by lands, which are portions of the cylindrical exterior 21. The width of each groove 23 is approximately the same as the distance between each groove 23.

Also, preferably jacket 19 has a flat or recess 25 formed on a portion of its cylindrical exterior 21. Recess 25 in this embodiment has a flat base 25*a* with two inclined sidewalls 25*b* and 25*c* on each side of recess 25. Recess 25 extends longitudinally, parallel with the axis of jacket 19. The width of recess 25 is proportional to an angle a, which is the angular distance from side edges 25*b* to 25*c*. In this embodiment, angle a is between 50 and 90°, and preferably about 70°. In this range, base 25*a* is a distance b from an outer diameter line that is the same as the outer diameter of cylindrical exterior 21. Distance b divided by a radius of cylindrical exterior 21 is in the range from about 0.15 to 0.35 and preferably 0.25.

A metal tube or tubing 27, also referred to as coiled tubing, extends around jacket 19. Tubing 27 is preferably formed from stainless steel, such as 316L stainless steel. Tubing 27 is formed from a flat plate that is rounded to form a cylinder with its side edges abutting each other to form a seam 29 that is welded. Initially, tubing 27 will be formed to a great inner diameter than the outer diameter of jacket 19. FIG. 1 exaggerates the difference, and in the preferred embodiment, the difference in diameter is in the range from 0.030 to 0.050 inch and preferably about 0.040 inch. This difference creates an initial clearance between jacket cylindrical exterior 21 and the inner diameter of tubing 27.

FIG. 3 schematically illustrates the manufacturing process, with forming rollers 31 deforming a flat plate into a cylindrical configuration around jacket 19 in a continuous process. Then, a torch 33 welds seam 29 (FIG. 1). Recess 25 (FIG. 1) is oriented under seam 29 so as to protect jacket 19 from excessive heat during the welding procedure. After welding, tubing 27 undergoes a swaging process with swage rollers 35 to reduce the diameter. This process causes the inner diameter of tubing 27 to come into tight frictional contact with jacket cylindrical exterior 21. The outer diameter of jacket exterior 21 will reduce some, with the deformed material of jacket 19 being accommodated by grooves 23 and recess 25. Preferably the outer diameter of tubing 27 after swaging is less than one inch, and preferably about 0.75 inch. In an embodiment with an outer diameter of 0.75 inch after swaging, jacket 19 had an outer diameter and tubing 27 had an inner diameter of about 0.620 inch, which places base 25 a distance b of about 0.077 inch from the inner diameter of tubing 27.

Tubing 27 is not annealed after the welding process, thus heater cable 11 is ready for use after the swaging process. The 316L stainless steel material of tubing 27 has been found to be capable of handling a large number of flexing cycles without undergoing an annealing process. In one test, tubing 27 was able to undergo 5,000 flexures without fatigue causing cracking in tubing 27. The tight grip of the inner wall of tubing 27 with jacket 19 after swaging causes the weight of conductors 13 and jacket 19 to be transferred to tubing 27. Spaced apart supports between jacket 19 and tubing 27 are not necessary.

Figure 4:
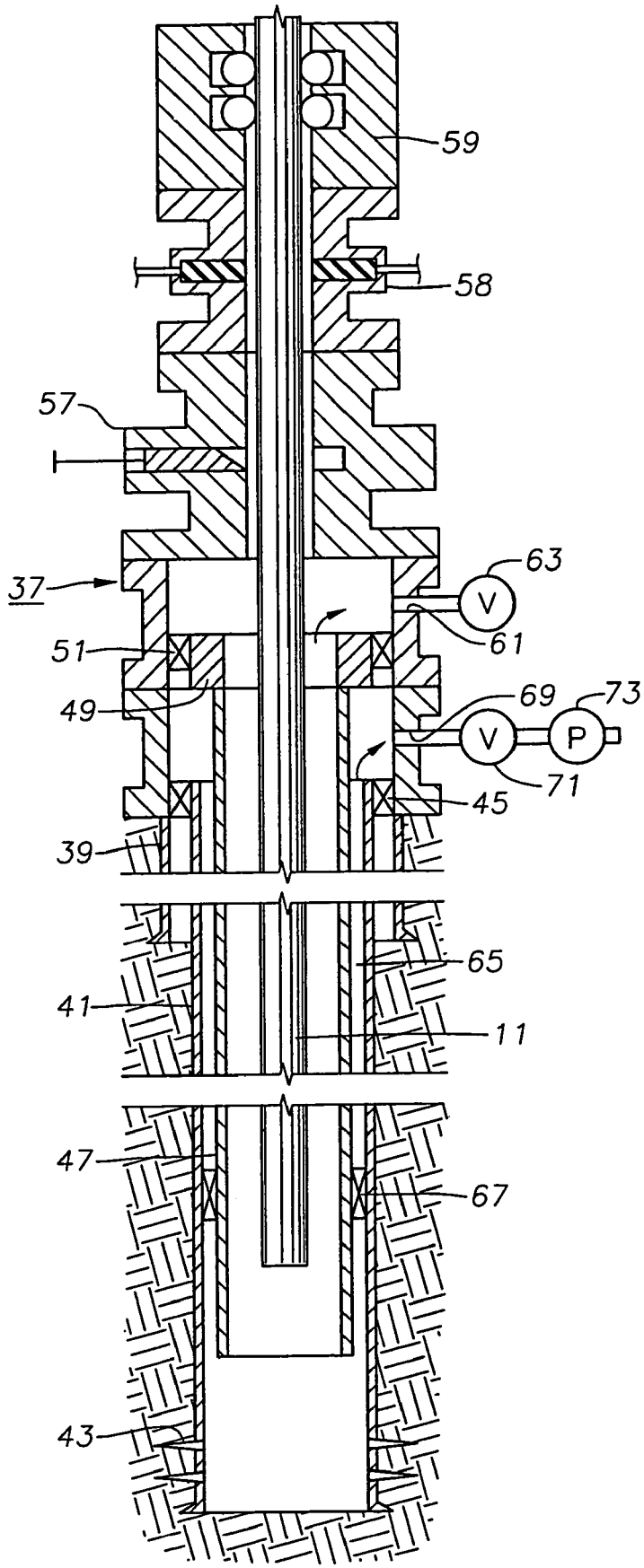
FIG. 4 is a schematic sectional view illustrating a well in the process of having the cable of FIGS. 1 and 2 installed therein.

FIG. 4 illustrates one method for installing heater cable 11 within a well. A Christmas tree or wellhead 37 is located at the surface or upper end of a well for controlling flow from the well. Wellhead 37 is located at the upper end of a string of conductor pipe 39, which is the largest diameter casing in the well. A string of production casing 41 is supported by wellhead 37 and extends to a greater depth than conductor pipe 39. There may be more than one string of casing within conductor pipe 39. In this example, production casing 41 is perforated near the lower end with perforations 43 that communicate a gas bearing formation with the interior of production casing 41. A casing hanger 45 and packoff support and seal of production casing 41 to wellhead 37. Conductor pipe 39 and production casing 41 are cemented in place.

In this embodiment, a string of production tubing 47 extends into casing 41 to a point above perforations 43. Typically production tubing 47 is made up of sections of pipe screwed together. Production tubing 47 has an open lower end for receiving flow from perforations 43. A tubing hanger 49 lands in wellhead 37 and supports production tubing 47. A packoff 51 seals tubing hanger 49 to the bore of wellhead 37. Production tubing 47 may be conventional, or it may have a liner of a reflective coating facing inward for retaining heat within tubing 47.

In the embodiment shown in FIG. 4, heater cable 11 is lowered into production tubing 47 to a selected depth while the well is live. That is, the well has not been killed by circulating a heavy kill fluid, thus has pressure in wellhead 37. The depth of heater cable 11 need not be all the way to the lower end of production tubing 47. Preferably, heater cable 11 has a closed lower end and its interior is free of any communication with production fluids. A shorting bar 55, shown in FIG. 5, electrically joins the three conductors 13 to each other. Shorting bar 55 is located at the lower end of heater cable 11.

Wellhead 37 has a valve 57, such as a gate valve, that maybe closed to block well pressure in wellhead 37 above tubing 47. During the preferred installation procedure for heater cable 11, valve 57 will be initially closed, and a set of coiled tubing rams 58 will be mounted to the upper end of wellhead 37. Rams 58 are sized to close around the smooth exterior of heater cable 11 to form a seal. A coil tubing injector 59 is mounted above rams 58. Tubing injector 59 is of a conventional type that will grip the exterior of coiled tubing 27 and push it downward into the well. Coiled tubing injector 59 also has a conventional blowout preventer or pressure controller (not shown) that seals around coiled tubing 27 while pushing it downward.

During the installation procedure, heater cable 11 will be inserted through tubing injector 59 and rams 58 while valve 57 is closed. After coiled tubing injector 59 forms seal on heater cable 11, valve 57 is opened, and heater cable 11 is pushed into production tubing 47. Injector assembly 59 prevents leakage of gas pressure as heater cable 11 is inserted into production tubing 47.

When at the desired depth, the operator will close rams 58 around coiled tubing 11 to form a static seal. The upper end of heater cable 11 is cut and injector assembly 59 is removed. A coiled tubing hanger (not shown) will be mounted above rams 58 to provide a permanent seal around heater cable 11, which enables rams 58 to be opened. Valve 57 remains open and will not be closed while heater cable 11 is in the well except in the event of an emergency. In an event of emergency, valve 57 may be closed, resulting in heater cable 11 being sheared.

To avoid excess energy requirement, it is beneficial to insulate production tubing 47 against heat losses. In the embodiment of FIG. 4, this is handled by a vacuum. Production tubing 47 has a production flow line or outlet 61 with a valve 63 at wellhead 37. A tubing annulus 65 surrounds production tubing 47 between tubing 47 and production casing 41, with the lower end of tubing annulus 65 being at a packer 67. Packer 67 is located at or near the lower end of tubing 47 and seals production tubing 47 to casing 41. Tubing Annulus 65 communicates with aport 69 in wellhead 37. A valve 71 at port 69 is connected to a line leading to a vacuum pump 73. Vacuum pump 73 causes pressure in tubing annulus 65 to reduce below atmospheric pressure. This provides insulation to retard heat loss from tubing 57. The vacuum level may be monitored with vacuum pump 73 periodically operating to maintain a desired level of vacuum.

Conductors 13 (FIG. 1) are connected to a voltage controller (not shown) that supplies electrical power to heater cable 11 to create a desired amount of heat. The electrical power supplied should provide an amount of heat sufficient to raise the temperature of the gas to reduce any condensation levels that are high enough to restrict gas flow. The temperature of the gas need not be above its dew point, because gas will still flow freely up the well so long as large droplets do not form, which fall due to gravity and restrict gas flow. The large droplets create friction which lowers the production rate. Some condensation can still occur without adversely affecting gas flow, particularly condensation in a cloudy state with small droplets. The amount of heat needs to be only enough to prevent the development of a large pressure gradient in the gas flow stream due to condensation droplets. Eliminating condensate that causes frictional losses allows the pressure to remain higher, increasing the rate of production. Increasing the temperature far above the necessary level to avoid losses would not be economical because it requires additional energy to create without reducing the detrimental pressure gradient. An adequate amount of heat has been found to be enough to create a temperature in tubing annulus 65 that is about 60 to 150 degrees F. above the temperature in the well. The water and hydrocarbon vapors that remain in the gas will be separated from the gas at the surface by conventional separation equipment.

The invention has significant advantages. The insulated conductors are installed in a continuous process while the coiled tubing is being formed. This avoids the need for pulling electrical cable through pre-formed tubing. By utilizing stainless steel, the conventional annealing step required for coiled tubing is omitted, which otherwise would result in temperatures that would be too high for the electrical cable to withstand. The coiled tubing has a smooth outer diameter for sealing with conventional coiled tubing injector equipment. Since the cable does not need internal supports for transferring weight of the insulated conductors to the coiled tubing, the outer diameter may be quite small. This provides a greater flow area in the production tubing for the production fluids as well as making sealing on the outer diameter of the cable easier. Evacuating the tubing annulus reduces loss from the production tubing. Installing the heater cable in a live well avoids risking killing procedures.

While the invention has been shown in only one of its forms, it should be apparent to those skilled in the art that it is not so limited but is susceptible to various changes without departing from the scope of the invention. For example, if the initial inner diameter of the coiled tubing is sufficiently greater than the heater cable jacket, it is possible to eliminate the recess adjacent the weld seam.

The invention claimed is:

1. A method for manufacturing an electrical cable, comprising:
   (a) assembling three insulated conductors in contact with each other and extruding a jacket of unexpanded elastomeric material over the insulated conductors;
   (b) rolling a metal plate around the jacket to form a cylindrical tubing having a seam; then
   (c) welding the seam; then
   (d) swaging the tubing to a lesser diameter wherein an inner wall of the tubing frictionally grips the jacket.

2. The method according to claim 1, wherein step (b) comprises forming the cylindrical tubing with an initial inner diameter a selected amount greater than an outer diameter of the jacket.

3. The method according to claim 1, wherein step (b) comprises forming the cylindrical tubing with an initial inner diameter at least 0.030 inch greater than an outer diameter of the jacket.

4. The method according to claim 1 wherein step (a) comprises forming the jacket with an ethylenepropylenediene monomer material.

5. The method according to claim 1, wherein step (b) comprises forming the plate of stainless steel.

6. A method for manufacturing an electrical cable, comprising:
   (a) extruding an elastomeric jacket over at least one insulated conductor;
   (b) rolling a metal plate around the jacket to form a cylindrical tubing having a seam; then
   (c) welding the seam; then
   (d) swaging the tubing to a lesser diameter wherein an inner wall of the tubing frictionally grips the jacket; and wherein:
   step (a) comprises forming a longitudinal recess in the jacket; and
   step (b) comprises aligning the seam with the recess.

7. A method for manufacturing a heater cable for a well, comprising:
   (a) continuously extruding a jacket of a deformable thermoplastic material over a plurality of insulated conductors, and providing the jacket with a cylindrical exterior having a plurality of longitudinally extending grooves;
   (b) continuously rolling a metal plate around the jacket to form a cylindrical tubing having a seam;
   (c) welding the seam; then
   (d) swaging the tubing to a lesser diameter, wherein an inner wall of the tubing frictionally grips and deforms the jacket, and the grooves deflect to accommodate portions of the deformed material of the jacket.

8. The method according to claim 7, further comprising cutting the tubing, the jacket and the insulated conductors at a desired length to form a lower end of the cable, then joining the conductors electrically to each other at the lower end.

9. The method according to claim 8, further comprising closing the lower end of the tubing after the conductors are electrically joined to seal the interior of the tubing.

10. The method according to claim 8, further comprising insulating the lower ends of the conductors from the tubing, and sealing the tubing from entry of fluids from the exterior into the interior of the tubing.

11. The method according to claim 7, wherein step (d) comprises swaging the tubing to an outer diameter that is less than 1.00 inch.

12. The method according to claim 7 wherein step (a) comprises forming the jacket with an ethylenepropylenediene monomer material.

13. The method according to claim 7, wherein step (b) comprises forming the plate of stainless steel.

14. The method according to claim 7 wherein:

step (a) comprises forming a longitudinal recess in the jacket; and step (b) comprises aligning the seam with the recess.

15. A method for applying heat to a well, comprising:

(a) forming a heater cable by extruding a jacket over a plurality of insulated conductors, rolling a metal plate around the jacket to form a cylindrical tubing having a seam, welding the seam, then swaging the tubing to a lesser diameter, wherein an inner wall of the tubing frictionally grips the jacket;

(b) electrically joining lower ends of the conductors and deploying the heater cable into the well;

(c) applying electrical power to the conductors to cause heat to be generate; and wherein step (a) comprises forming the cylindrical tubing with an initial inner diameter at least 0.030 inch greater than an outer diameter of the jacket.

16. The method according to claim 15, wherein step (b) comprises forming the cylindrical tubing with an initial inner diameter a selected amount greater than an outer diameter of the jacket.

17. The method according to claim 15 wherein:

step (a) comprises forming a longitudinal recess in the jacket; and step (b) comprises aligning the seam with the recess.

18. A method for applying heat to a well, comprising:

(a) forming a heater cable by extruding a jacket over a plurality of insulated conductors, rolling a metal plate around the jacket to form a cylindrical tubing having a seam, welding the seam, then swaging the tubing to a lesser diameter, wherein an inner wall of the tubing frictionally grips the jacket;

(b) electrically joining lower ends of the conductors and deploying the heater cable into the well;

(c) applying electrical power to the conductors to cause heat to be generated; and wherein step (b) further comprises closing a lower end of the tubing to prevent entry of well fluids into the interior of the tubing.

19. A method for applying heat to a well, comprising:

(a) forming a heater cable by extruding a jacket over a plurality of insulated conductors, rolling a metal plate around the jacket to form a cylindrical tubing having a seam, welding the seam, then swaging the tubing to a lesser diameter, wherein an inner wall of the tubing frictionally grips the jacket;

(b) electrically joining lower ends of the conductors and deploying the heater cable into the well;

(c) applying electrical power to the conductors to cause heat to be generated; and wherein step (b) further comprises insulating the lower ends of the conductors from the tubing, and sealing the tubing to prevent entry of well fluids into contact with the conductors.

* * * * *

UNITED STATES PATENT AND TRADEMARK OFFICE

CERTIFICATE OF CORRECTION

PATENT NO. : 7,044,223 B2
APPLICATION NO. : 10/781365
DATED : May 16, 2006
INVENTOR(S) : Larry V. Dalrymple et al.

It is certified that error appears in the above-identified patent and that said Letters Patent is hereby corrected as shown below:

Title Page

In the Abstract:

(57) line 7, delete “maybe” and insert --may be-- before “formed”

Column 4, line 43, delete “maybe” before “closed”
Column 4, line 57, insert --a-- before “seal”
Column 5, line 14, delete “Annulus” and insert --annulus--
Column 5, line 14, delete “aport” and insert --a port--

Signed and Sealed this

Twenty-eighth Day of November, 2006

JON W. DUDAS
*Director of the United States Patent and Trademark Office*